US005658388A

United States Patent [19]

Shiroeda

[11] Patent Number: 5,658,388

[45] Date of Patent: Aug. 19, 1997

[54] SHEET FORMING MACHINE

[75] Inventor: Yoshihiro Shiroeda, Shiga-ken, Japan

[73] Assignee: Murata Manufacturing Co., Ltd., Japan

[21] Appl. No.: 532,355

[22] Filed: Sep. 22, 1995

[30] Foreign Application Priority Data

Sep. 28, 1994 [JP] Japan ..... 6-233067

[51] Int. Cl.[6] ..... B05C 11/00

[52] U.S. Cl. ..... 118/668; 118/663; 118/708; 118/712

[58] Field of Search ..... 118/712, 668, 118/663, 708, 419, 405, 415, 407; 427/8, 428, 434.2

[56] References Cited

U.S. PATENT DOCUMENTS 5,523,122 6/1996 Harada et al. ..... 427/287

*Primary Examiner*—Laura Edwards
*Assistant Examiner*—Steven B. Leavitt
*Attorney, Agent, or Firm*—Ostrolenk, Faber, Gerb & Soffen, LLP

[57] ABSTRACT

A sheet forming machine which has a pair of coating rolls, a driving mechanism for rotating the coating rolls, angle detectors for detecting rotation angles of the coating rolls, level change detectors for detecting change patterns of levels of circumferential points of the coating rolls, and a shaft mover for moving at least one of the coating rolls to keep a constant space between the coating rolls.

3 Claims, 3 Drawing Sheets

SHEET FORMING MACHINE

BACKGROUND OF THE INVENTION

1. Field of the Invention

The present invention relates to a sheet forming machine which forms a slurry material into a sheet by use of a pair of coating members.

2. Description of Related Art

Generally, ceramic green sheets are made by casting. In the casting, a slurry material is continuously poured onto a traveling organic film as a sheet with a specified thickness, and the material on the organic film is dried and rolled up during the travel of the organic film. A sheet forming machine is used to carry out the casting.

Conventionally, a sheet forming machine is provided with a reverse roll coater as shown in FIG. 3, a knife coater as shown in FIG. 4 or the like so as to continuously pour a slurry material onto an organic film.

The reverse roll coater of FIG. 3 has a pair of coating rolls $R_1$ and $R_2$, and a back-up roll $R_3$. The rolls $R_1$, $R_2$ and $R_3$ are rotated in the same direction (clockwise direction in this example). The coating rolls $R_1$ and $R_2$ are arranged opposite each other with a specified space H in-between. While a slurry material S is poured through the space between the coating rolls $R_1$ and $R_2$, an organic film B is continuously fed by the back-up roll $R_3$. Thereby, the material S poured through the space between the coating rolls $R_1$ and $R_2$ comes onto the organic film B, and the material S is made into a sheet F.

The knife coater of FIG. 4 has a coating knife N, a coating roll $R_2$ and a back-up roll $R_3$. The rolls $R_2$ and $R_3$ are rotated in the same direction (clockwise direction in this example). While a slurry material S is poured through the space H between the coating knife N and the coating roll $R_2$, an organic film B is continuously fed by the back-up roll $R_3$. Thereby, the material S poured through the space between the knife N and the roll $R_2$ comes onto the organic film B, and the material S is made into a sheet F.

In the reverse roll coater of FIG. 3, the space H between the coating rolls $R_1$ and $R_2$ serves as an inlet of the material S and is an important factor which determines the thickness of the sheet F. Likewise, in the knife coater of FIG. 4, the space H between the coating knife N and the coating roll $R_2$ is an important factor which determines the thickness of the sheet F. Therefore, in order to make a sheet F with a uniform thickness, the space H must be kept constant while the coating rolls $R_1$ and $R_2$ are rotating.

However, it is difficult to produce exactly cylindrical rolls $R_1$ and $R_2$ because of errors in processing, and the rolls $R_1$ and $R_2$ generally have out-of-roundness of about several micrometers to scores of micrometers. Also, even if an exact cylindrical roll can be produced, because of errors in providing a shaft to the cylindrical roll, eccentricity is generated. Accordingly, while the coating rolls $R_1$ and $R_2$ are rotating, the level of the circumferential point of each roll which faces the other roll changes periodically. Consequently, the space H between the rolls $R_1$ and $R_2$ in the reverse roll coater of FIG. 3 or the space H between the knife N and the roll $R_2$ in the knife coater of FIG. 4 changes during the rotation of the coating rolls $R_1$ and $R_2$.

The change of the space H is described in connection with the reverse roll coater of FIG. 3. As shown in FIG. 2*a*, the coating roll $R_1$ is rotated at a relatively low speed, and the level of the circumferential point facing the roll $R_2$ changes periodically as indicated by a curve $C_1$. The coating roll $R_2$ is rotated at a higher speed, and the level of the circumferential point facing the roll $R_1$ changes periodically as indicated by a curve $C_2$. The change of the space H between the rolls $R_1$ and $R_2$ is indicated as the change of the distance between the curves $C_1$ and $C_2$. The space between the rolls $R_1$ and $R_2$ is $H_1$ at a moment and is $H_2(\neq H_1)$ at another moment.

In accordance with the change of the space H between the rolls $R_1$ and $R_2$, the thickness of the material S poured through the space H changes. Thus, it is difficult to form a sheet F with a uniform thickness.

SUMMARY OF THE INVENTION

An object of the present invention is to provide a sheet forming machine which can form a sheet with a uniform thickness by keeping a constant space between a pair of coating members which serves as an inlet of a material.

A sheet forming machine according to the present invention comprises: a pair of coating members, at least one of which is a coating roll; driving means for rotating the coating roll; angle detecting means for detecting a rotation angle of the coating roll; level change detecting means for detecting a change pattern of a level of a circumferential point of the coating roll; and moving means for moving one of the coating members so as to keep a constant space between the coating members.

In the structure, the angle detecting means detects the rotation angle of the coating roll. The level change detecting means detects the level of a circumferential point of the coating roll during its rotation and recognizes a change pattern of the level.

In accordance with an output of the angle detecting means and an output of the level detecting means, the moving means moves at least one of the coating members such that a constant space can be kept between the pair of coating members.

In this way, the space between the coating members, which serves as an inlet of a material, can be kept constant, and consequently, a sheet with a uniform thickness can be formed. With this arrangement, it is not necessary to improve the production accuracy of coating rolls, and an increase in the production cost of coating rolls can be avoided.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

An embodiment of the present invention is described with reference to the accompanying drawings.

Figure 1:
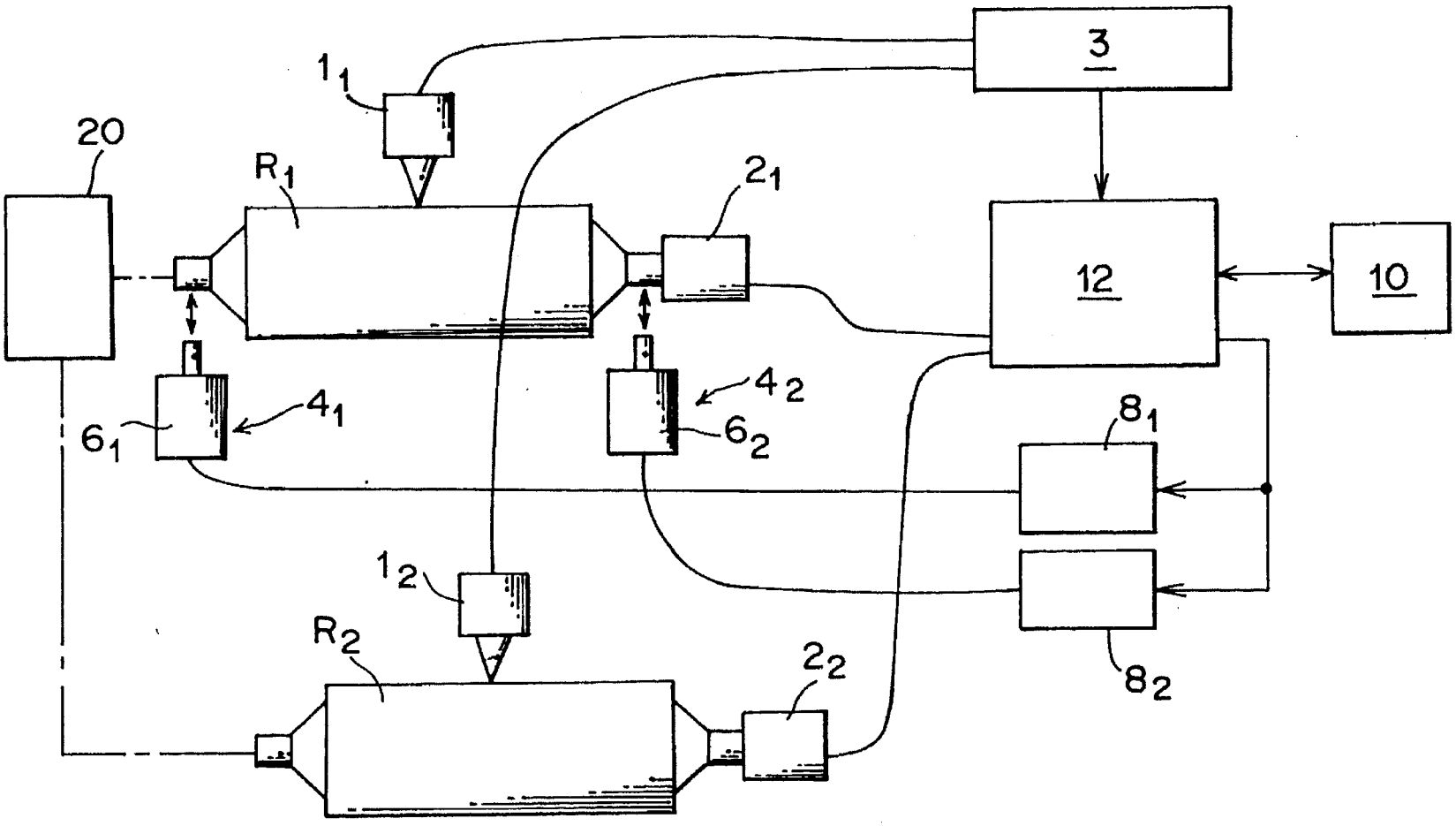
FIG. 1 is a schematic view of a sheet forming machine according to the present invention.

FIG. 1 is a schematic view of a sheet forming machine according to the present invention. The sheet forming machine has a reverse roll coater, and the reverse roll coater comprises a pair of coating rolls $R_1$ and $R_2$, and a back-up roll (not shown). The coating rolls $R_1$ and $R_2$ are connected to a drive mechanism 20 to rotate on respective shafts. The coating rolls $R_1$ and $R_2$, and the back-up roll are rotated in the same direction.

The coating rolls $R_1$ and $R_2$ are arranged opposite each other with a specified space in-between. While a slurry material is poured through the space between the coating rolls $R_1$ and $R_2$, an organic film is continuously fed by the back-up roll. Thereby, the material poured through the space between the rolls $R_1$ and $R_2$ comes onto the organic film, and the material is made into a sheet.

The coating rolls $R_1$ and $R_2$ are provided with level detectors $\mathbf{1}_1$ and $\mathbf{1}_2$ and angle detectors $\mathbf{2}_1$ and $\mathbf{2}_2$, respectively. The level detectors $\mathbf{1}_1$ and $\mathbf{1}_2$ detect the levels of circumferential points of the respective rolls $R_1$ and $R_2$ during rotation of the rolls $R_1$ and $R_2$, and the angle detectors $\mathbf{2}_1$ and $\mathbf{2}_2$ detect the rotation angles of the respective rolls $R_1$ and $R_2$.

In the embodiment, the level detectors $\mathbf{1}_1$ and $\mathbf{1}_2$ are differential transforming contact type sensors. However, non-contact type gap detectors can be used as the level detectors $\mathbf{1}_1$ and $\mathbf{1}_2$. Each of the level detectors $\mathbf{1}_1$ and $\mathbf{1}_2$ can be set to detect any circumferential point of each roll.

The level detectors $\mathbf{1}_1$ and $\mathbf{1}_2$ are connected to a level change calculator 3. From outputs of the level detectors $\mathbf{1}_1$ and $\mathbf{1}_2$, the level change calculator 3 calculates change values of the levels of the circumferential points of the rolls $R_1$ and $R_2$ during rotation of the rolls $R_2$ and $R_2$.

In the embodiment, only a single level detector is provided to each of the coating rolls $R_1$ and $R_2$. However, in order for more accurate detection, two or more level detectors may be provided to each of the coating rolls $R_1$ and $R_2$ to detect the levels of a plurality of circumferential points of each roll.

The angle detectors $\mathbf{2}_1$ and $\mathbf{2}_2$ are, in the embodiment, rotary encoders fitted to the shafts of the coating rolls $R_1$ and $R_2$.

Further, to the coating roll $R_1$, shaft movers $\mathbf{4}_1$ and $\mathbf{4}_2$ are provided. The shaft movers $\mathbf{4}_1$ and $\mathbf{4}_2$ move the shaft of the coating roll $R_1$ in the radial direction to keep the space between the coating rolls $R_1$ and $R_2$ constant.

The shaft movers $\mathbf{4}_1$ and $\mathbf{4}_2$ comprise a pair of actuators $\mathbf{6}_1$ and $\mathbf{6}_2$ of an electric, hydraulic, pneumatic or piezoelectric type, and actuator drivers $\mathbf{8}_1$ and $\mathbf{8}_2$ which are connected to the actuators $\mathbf{6}_1$ and $\mathbf{6}_2$ respectively.

Numeral 12 denotes a controller which has a microcomputer. The controller 12 receives change values of the levels of the circumferential points of the coating rolls $R_1$ and $R_2$ from the change value calculator 3 and rotation angles of the rolls $R_1$ and $R_2$ from the angle detectors $\mathbf{2}_1$ and $\mathbf{2}_2$. From these values, the controller 12 calculates change values of the levels of the mutually facing circumferential points of the coating rolls $R_1$ and $R_2$ at various rotation angles. Then, data about the change values at various rotation angles are stored in a memory 10. The memory 10 comprises a disk unit, a RAM, etc. During sheet forming, the controller 12 reads the rotation angles of the coating rolls $R_1$ and $R_2$ detected by the angle detectors $\mathbf{2}_1$ and $\mathbf{2}_2$, and judges the change values of the levels of the mutually facing circumferential points of the rolls $R_1$ and $R_2$ at the detected rotation angles, referring to the data stored in the memory 10. Then, the controller 12 calculates a shaft moving value to keep the space H between the coating rolls $R_1$ and $R_2$ at a specified value, and transmits the shaft moving value to the actuator drivers $\mathbf{8}_1$ and $\mathbf{8}_2$.

Next, sheet forming out of a slurry material by use of the sheet forming machine is described.

Before sheet forming, the coating rolls $R_1$ and $R_2$ are rotated to collect data to be stored in the memory 10. More specifically, during the rotation, outputs of the angle detectors $\mathbf{2}_1$ and $\mathbf{2}_2$ and outputs of the level detectors $\mathbf{1}_1$ and $\mathbf{1}_2$ are read by the controller 12, and data about change values of the levels of the mutually facing circumferential points of the rolls $R_1$ and $R_2$ at various rotation angles of the rolls $R_1$ and $R_2$ are made from the outputs and stored in the memory 10.

Figure 2A:
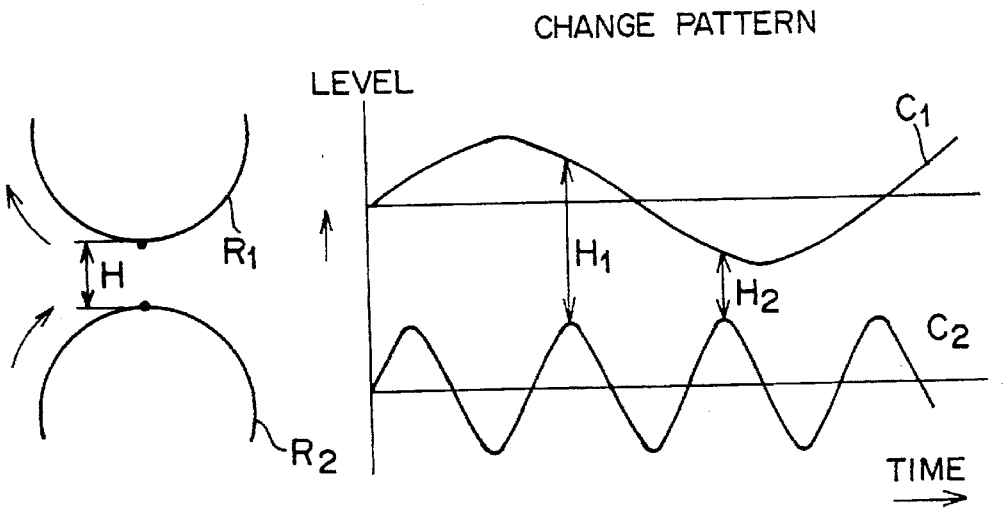
FIGS. 2*a* and 2*b* are graphs showing change patterns of the levels of circumferential points of a pair of coating rolls during rotation of the coating rolls.

For example, the rotation of the coating rolls $R_1$ and $R_2$ is recognized as shown by the graph of FIG. 2*a*. The coating roll $R_1$ is rotated at a relatively low speed, and the change of the level of a circumferential point of the roll $R_1$ is detected as a pattern indicated by a curve $C_1$. The coating roll $R_2$ is rotated at a higher speed, and the change of the level of a circumferential point of the roll $R_2$ is detected as a pattern indicated by a curve $C_2$. Data shown as the curves $C_1$ and $C_2$ are stored in the memory 10.

During sheet forming, the controller 12 reads the rotation angles of the coating rolls $R_1$ and $R_2$ from outputs of the angle detectors $\mathbf{2}_1$ and $\mathbf{2}_2$. Then, the controller 12 judges the change values of the levels of the mutually facing circumferential points of the coating rolls $R_1$ and $R_2$ at the detected rotation angles, referring to the data stored in the memory 10.

From the change patterns, the controller 12 judges the change values of the levels of the mutually facing circumferential points of the coating rolls $R_1$ and $R_2$. More specifically, the change value of the level of the circumferential point of the coating roll $R_1$ is judged referring to the curve $C_1$, and the change value of the level of the circumferential point of the coating roll $R_2$ is judged referring to the curve $C_2$. In this embodiment, the shaft movers $\mathbf{4}_1$ and $\mathbf{4}_2$ are provided only to the coating roll $R_1$. From the change values of the coating rolls $R_1$ and $R_2$, the controller 12 calculates a shaft moving value which determines the moving amount of the shaft of the coating roll $R_1$. Then, the controller 12 transmits data about the shaft moving value to the actuator drivers $\mathbf{8}_1$ and $\mathbf{8}_2$.

Figure 2B:
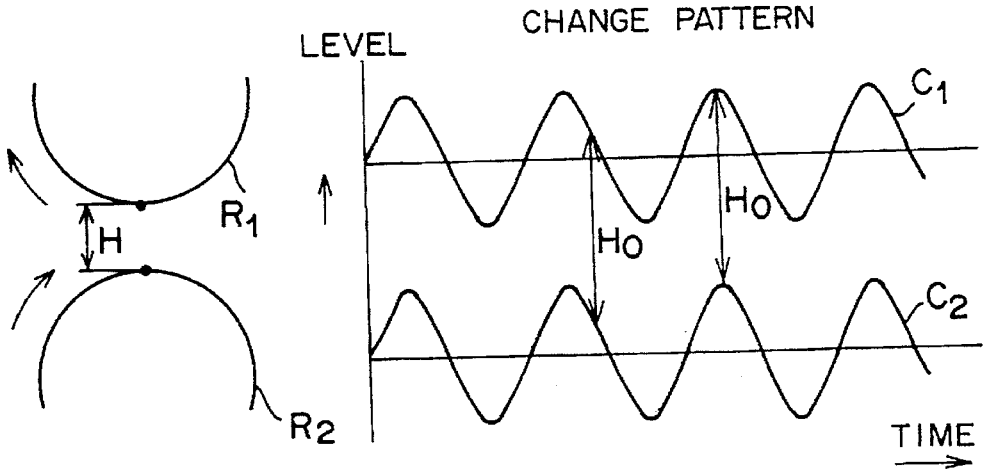
Figure 3:
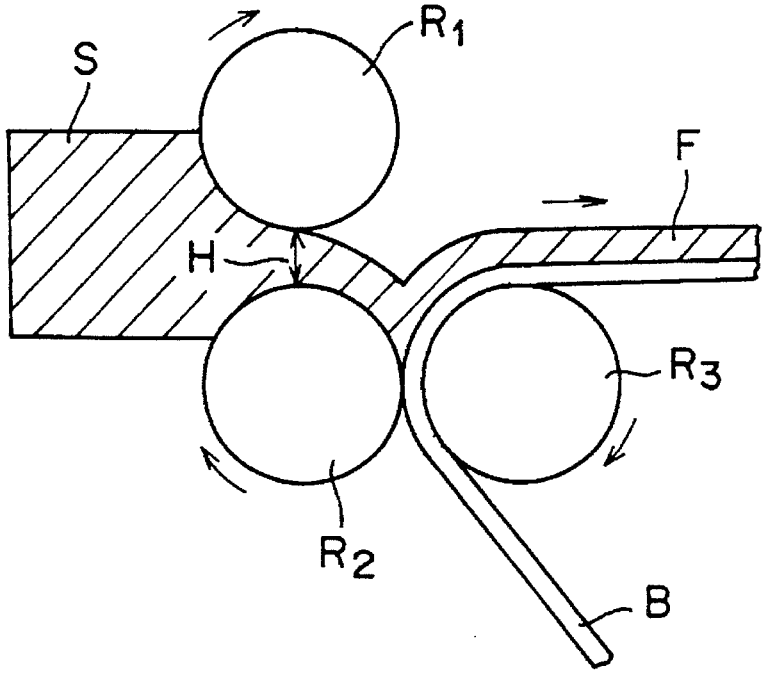
FIG. 3 is a side view of a conventional reverse roll coater provided in a sheet forming machine.
Figure 4:
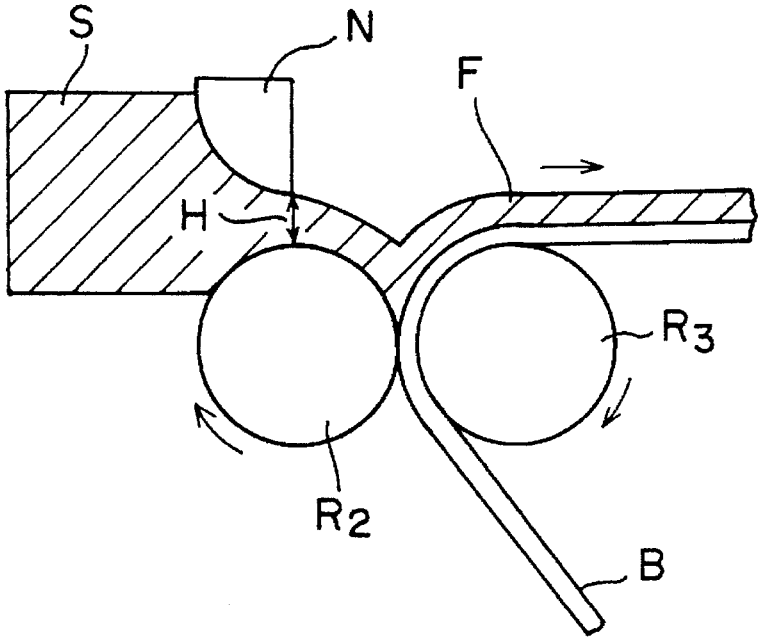
FIG. 4 is a side view of a conventional knife coater provided in a sheet forming machine.

Thereby, as shown in FIG. 2*b*, the shaft of the coating roll $R_1$ is moved such that the level of the circumferential point of the coating roll $R_1$ facing the coating roll $R_2$ changes in synchronization with the change of the level of the circumferential point of the coating roll $R_2$ facing the coating roll $R_1$. Thus, the space H between the coating rolls $R_1$ and $R_2$ can be kept constant.

The space between the coating rolls $R_1$ and $R_2$ is $H_O$ at a moment, and the space therebetween at another moment is $H_O$.

Consequently, although the coating rolls $R_1$ and $R_2$ are out of round and eccentric, a sheet with a uniform thickness can be formed.

Although in the embodiment, the shaft movers $\mathbf{4}_1$ and $\mathbf{4}_2$ are provided only to the coating roll $R_1$, it is possible to provide the shaft movers to both the coating rolls $R_1$ and $R_2$. In that case, the shafts of the coating rolls $R_1$ and $R_2$ are moved so as to offset the changes of the levels of the mutually facing circumferential points of the respective rolls $R_1$ and $R_2$. Thereby, the space between the coating rolls $R_1$ and $R_2$ can be kept constant.

In the embodiment, the present invention is applied to a reverse roll coater. However, the present invention is applicable to a knife coater which has a coating knife N and a coating roll $R_2$. In this case, the level detector $\mathbf{1}_2$ and the angle detector $2_2$ may be provided only to the coating roll $R_2$, and the shaft movers $4_1$ and $4_2$ may be provided to at least one of the knife N and the roll $R_2$.

In the embodiment, data about change values of the levels of the mutually circumferential points of the coating rolls $R_2$ and $R_2$ are stored in the memory 10 before sheet forming, and the data are used for control of the shaft movers $4_1$ m and $4_2$ during sheet forming. However, it is possible to control the shaft movers $4_1$ and $4_2$ in accordance with outputs of the level detectors $1_1$ and $1_2$ and outputs of the angle detectors $2_1$ and $2_2$ which are sent during sheet forming.

Although the present invention has been described in connection with the preferred embodiment, it is to be noted that various changes and modifications are possible to those who are skilled in the art. Such changes and modifications are to be understood as being within the scope of the present invention.

What is claimed is:

1. A sheet forming machine for forming a slurry material into a sheet, comprising:

a pair of coating members which are arranged opposite each other with a nominal space in-between, at least one of the coating members being a coating roll, a slurry material being fed through the space between the coating members to be formed into a sheet;

a drive connected to said coating roll for rotating the coating roll;

an angle detector for detecting a rotation angle of the coating roll;

a level change detector disposed in communication with said coating roll for detecting a change pattern of a level of a circumferential point of the coating roll during rotation of the coating roll; and a mover connected to said coating roll for moving the coating roll in accordance with an output of the angle detector and an output of the level change detector so as to keep the space between the coating members constant.

2. A sheet forming machine as claimed in claim 1, wherein:

both coating members are coating rolls;

the angle detector detects respective rotation angles of the coating rolls;

the level change detector detects change patterns of levels of circumferential points of the coating rolls during rotation of the coating rolls; and the mover moves at least one of the coating rolls.

3. A sheet forming machine as claimed in claim 1, wherein the coating members include a coating roll which is rotated in one direction and a coating knife which is disposed opposite the coating roll at a specified space from the coating roll.

* * * * *